US007855701B2

(12) United States Patent
Yoo

(10) Patent No.: US 7,855,701 B2
(45) Date of Patent: Dec. 21, 2010

(54) ORGANIC ELECTRO-LUMINESCENCE DEVICE AND METHOD FOR DRIVING THE SAME

(75) Inventor: JuhnSuk Yoo, Seoul (KR)

(73) Assignee: LG Display Co., Ltd., Seoul (KR)

( * ) Notice: Subject to any disclaimer, the term of this patent is extended or adjusted under 35 U.S.C. 154(b) by 979 days.

(21) Appl. No.: 11/296,349

(22) Filed: Dec. 8, 2005

(65) Prior Publication Data

US 2006/0125409 A1 Jun. 15, 2006

(30) Foreign Application Priority Data

Dec. 10, 2004 (KR) ..... 10-2004-0103930

(51) Int. Cl.
*G09G 3/32* (2006.01)

(52) U.S. Cl. ..... 345/82

(58) Field of Classification Search ..... 345/82; 315/169.1–169.3

See application file for complete search history.

(56) References Cited

U.S. PATENT DOCUMENTS 6,229,506 B1 * 5/2001 Dawson et al. ..... 345/82
7,193,588 B2 * 3/2007 Lo ..... 345/76

* cited by examiner

*Primary Examiner*—Richard Hjerpe
*Assistant Examiner*—Carolyn R Edwards
(74) *Attorney, Agent, or Firm*—Birch, Stewart, Kolasch & Birch LLP

(57) ABSTRACT

An organic electro-luminescence device according to an embodiment includes a light-emitting device in a pixel for emitting light; a data line for providing a data voltage; and a driving transistor connected to the light emitting device, wherein when the driving transistor is turned on to drive the light-emitting device, a driving voltage applied to the light emitting device reaches a value of a difference between a supply voltage and the data voltage.

10 Claims, 5 Drawing Sheets

ORGANIC ELECTRO-LUMINESCENCE DEVICE AND METHOD FOR DRIVING THE SAME

This Nonprovisional Application claims priority under 35 U.S.C. §119(a) on Patent Application No. 10-2004-0103930 filed in Korea on Dec. 10, 2004, the entire contents of which are hereby incorporated by reference.

BACKGROUND OF THE INVENTION

1. Field of the Invention

The present invention relates to an organic electro-luminescence device, and more particularly, to an organic electro-luminescence device for improving picture quality and providing high gradation, and a method of driving the same.

2. Description of the Related Art

To replace heavy and bulky cathode ray tubes (CRTs), various kinds of flat panel displays have been recently developed.

Examples of the flat panel displays are a liquid crystal display (LCD), a field emission display (FED), a plasma display panel (PDP), an electro-luminescence display (ELD), etc. Many attempts have been made to provide an enhanced display quality and large screen of the flat panel displays.

Among the flat panel displays, the organic electro-luminescence device is a self-luminous display device that emits light by itself. The organic electro-luminescence device displays a predetermined image by exciting a phosphor material using carriers, such as electrons and holes. Accordingly, the organic electro-luminescence device can be driven at a low voltage and have a high response speed.

FIG. 1 is a circuit diagram illustrating a pixel structure of a related art organic electro-luminescence device.

The pixel structure of the organic electro-luminescence device driven by a voltage addressing is illustrated in FIG. 1.

Referring to FIG. 1, a driving transistor M1 is connected to an organic light-emitting diode (OLED) and supplies a driving current $I_{OLED}$ used for emission of light. An amount of the driving current $I_{OLED}$ of the driving transistor M1 is controlled by a data voltage applied through a switching transistor M2. At this point, a capacitor C1 for maintaining the applied voltage during a predetermined period is connected between source and gate of the driving transistor M1. Also, the switching transistor M2 has a gate connected to a gate line Sn, a source connected to a data line Dm, and a drain connected to the gate of the driving transistor M1.

Upon the operation of the organic electro-luminescence device with the above pixel structure, the switching transistor M2 is turned on by a select signal applied to the gate thereof, and a data voltage from the data line Dm is applied to the gate of the driving transistor M1. Then, the driving current $I_{OLED}$ corresponding to a voltage $V_{GS}$ charged between the gate and the source of the driving transistor M1 flows through the driving transistor M1. The OLED emits light in response to the driving current $I_{OLED}$. The driving current flowing through the OLED is expressed as $$(I_{OLED}) = \frac{\beta}{2}(V_{DD} - V_{DATA} - |V_{TH}|)^2$$

where $I_{OLED}$, $V_{th}$, $V_{DATA}$, and β represent the driving current flowing through the OLED, a threshold voltage of the transistor M1, a data voltage, and a constant value, respectively.

According to the pixel structure of FIG. 1, the driving current corresponding to the data voltage is applied to the OLED, and then the OLED emits light in response to the applied driving current. The applied data voltage has a multi-step value within a predetermined range to express gradation.

In the related art pixel structure, the deviation of the threshold voltage $V_{th}$ and the electron mobility in a thin film transistor is caused by non-uniformity of the manufacturing processes. Therefore, the luminance deviation occurs in each pixel, resulting in non-uniformity of the picture quality. Consequently, the picture quality is degraded. For example, when the thin film transistor of the pixel is driven at 3 V, 8-bit (256) gradation can be expressed by applying a voltage to the gate of the thin film transistor at intervals of 12 mV (3V/256). However, if the deviation of the threshold voltage in the thin film transistor is 100 mV due to non-uniformity of the manufacturing processes, the levels of the gradation for the thin film transistors with deviation of the threshold voltage would be reduced.

SUMMARY OF THE INVENTION

Accordingly, the present invention is directed to an organic electro-luminescence device and a method of driving the same that substantially obviate one or more problems due to limitations and disadvantages of the related art.

An object of the present invention is to provide an organic electro-luminescence device and a method of driving the same to achieve uniformity of the picture quality by buffering the OLED drive voltage from the outside and sending it in an internal circuit of a pixel.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an organic electro-luminescence device including: a light-emitting device in a pixel for emitting light; a data line for providing a data voltage; and a driving transistor connected to the light emitting device, wherein when the driving transistor is turned on to drive the light-emitting device, a driving voltage applied to the light emitting device reaches a value of a difference between a supply voltage and the data voltage.

In another aspect of the present invention, there is provided an organic electro-luminescence device including a light-emitting device in a pixel for emitting light; a driving transistor connected to the light emitting device for driving the light-emitting device; a data line for providing a data voltage; a first switching device connected to the data line; a capacitor connected to and between the first switching device and a gate terminal of the driving transistor; a second switching device between the gate of the driving transistor and a drain of the driving transistor; a third switching device between one of an anode and a cathode of the light-emitting device and a node between the first switching device and the capacitor; and a scan line connected to the first switching device, the second switching device and the third switching device for providing a scan signal to selectively turn on the first switching device, the second switching device and the third switching device.

In another aspect of the present invention, there is provided a method for driving an organic electro-luminescence device including supplying a data voltage via a data line in a first period to charge a capacitor between the data line and a driving transistor to a value of a difference between the data voltage and a threshold voltage of the driving transistor; and applying a driving voltage via the driving transistor and the capacitor to a light emitting device with a value of a difference between a supply voltage and the data voltage in a second period.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE ILLUSTRATED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

An organic electro-luminescence device includes a plurality of data lines, a plurality of gate lines intersected with the plurality of data lines, and pixels formed at intersections of the data lines and the gate lines in a matrix, thus defining a display region of a panel. Each of the pixels includes an OLED and a pixel circuit for driving the OLED. Also, a power line is formed in parallel to the data line and supplies a predetermined power VDD to each of the pixels.

Figure 1:
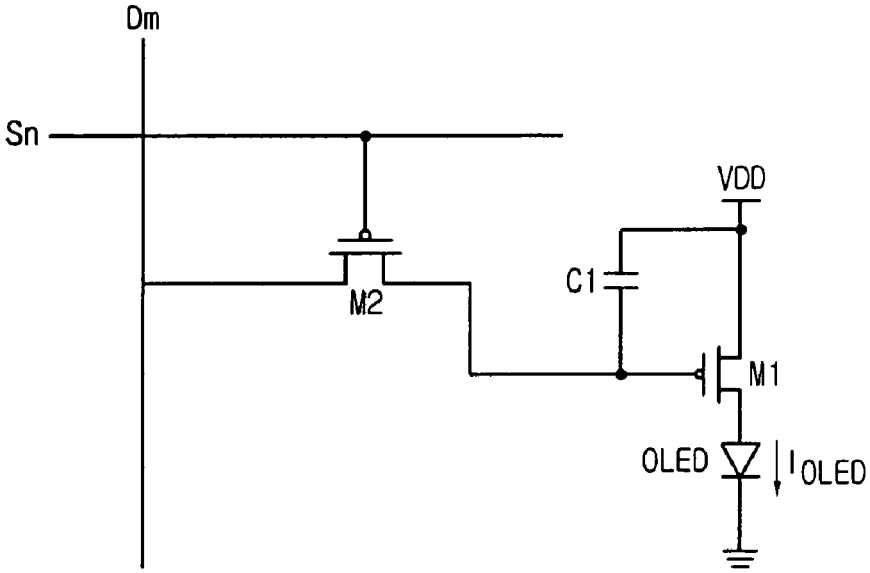
Fig.1 (Related Art)
FIG. 1 is a circuit diagram illustrating a pixel structure of a related art organic electro-luminescence device.
Figure 2:
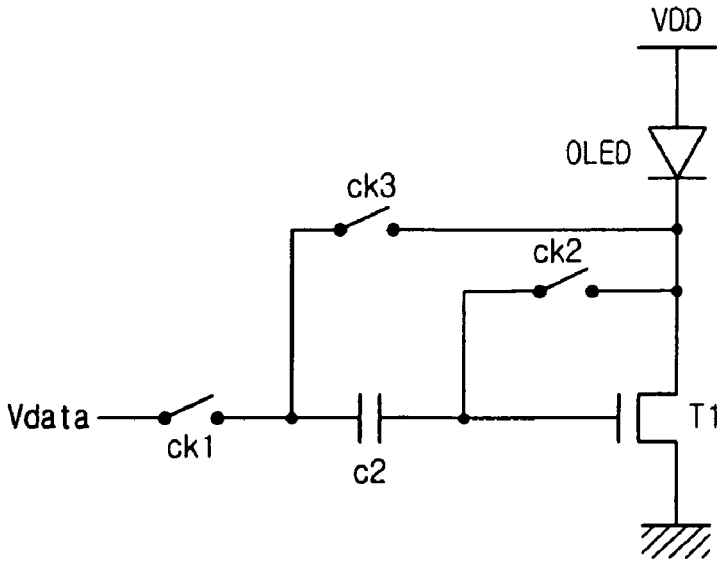
FIG. 2 is a circuit diagram illustrating a pixel structure of an organic electro-luminescence device according to an embodiment of the present invention.

FIG. 2 is a circuit diagram illustrating a pixel structure of an organic electro-luminescence device according to an embodiment of the present invention. It should be noted that although the organic electro-luminescent display device using n-type transistors is used to illustrate this embodiment, the present invention can also apply to the organic electro-luminescent display device using other transistors such as p-type transistors or other types of transistors.

Referring to FIG. 2, a driving transistor T1 is connected to an OLED and supplies a driving current to the OLED for emitting light. The pixel structure is configured such that a driving current supplied to the OLED is not affected by a threshold voltage $V_{th}$ of the driving transistor T1. That is, the OLED driving voltage will not be affected by the threshold voltage $V_{th}$ of the driving transistor T1.

Specifically, the driving transistor T1 includes a negative gain circuit in which the drain is connected to the gate by a switching element. A capacitor C2 is disposed between the gate of the driving transistor T1 and the data line.

The driving transistor T1 and the capacitor C2 constitutes a buffer circuit configured to buffer a driving voltage applied to the inside of the pixel.

Also, a first switching element ck1 is disposed between the data line and the capacitor C2. A second switching element ck2 is disposed between the drain and the gate of the driving transistor T1. A third switching element ck3 is disposed between the anode of the OLED and the data line.

Each of the switching elements ck1, ck2 and ck3 may be configured as a thin film transistor. The first and second switching elements ck1 and ck2 are operated by the same logic level. The third switching element ck3 is operated by a logic level opposite to the logic level supplied to the first and second switching elements ck1 and ck2.

That is, when the first and second switching elements ck1 and ck2 are turned on, the third switching element ck3 is turned off. Also, when the first and second switching elements ck1 and ck2 are turned off, the third switching element ck3 is turned on.

Figure 3:
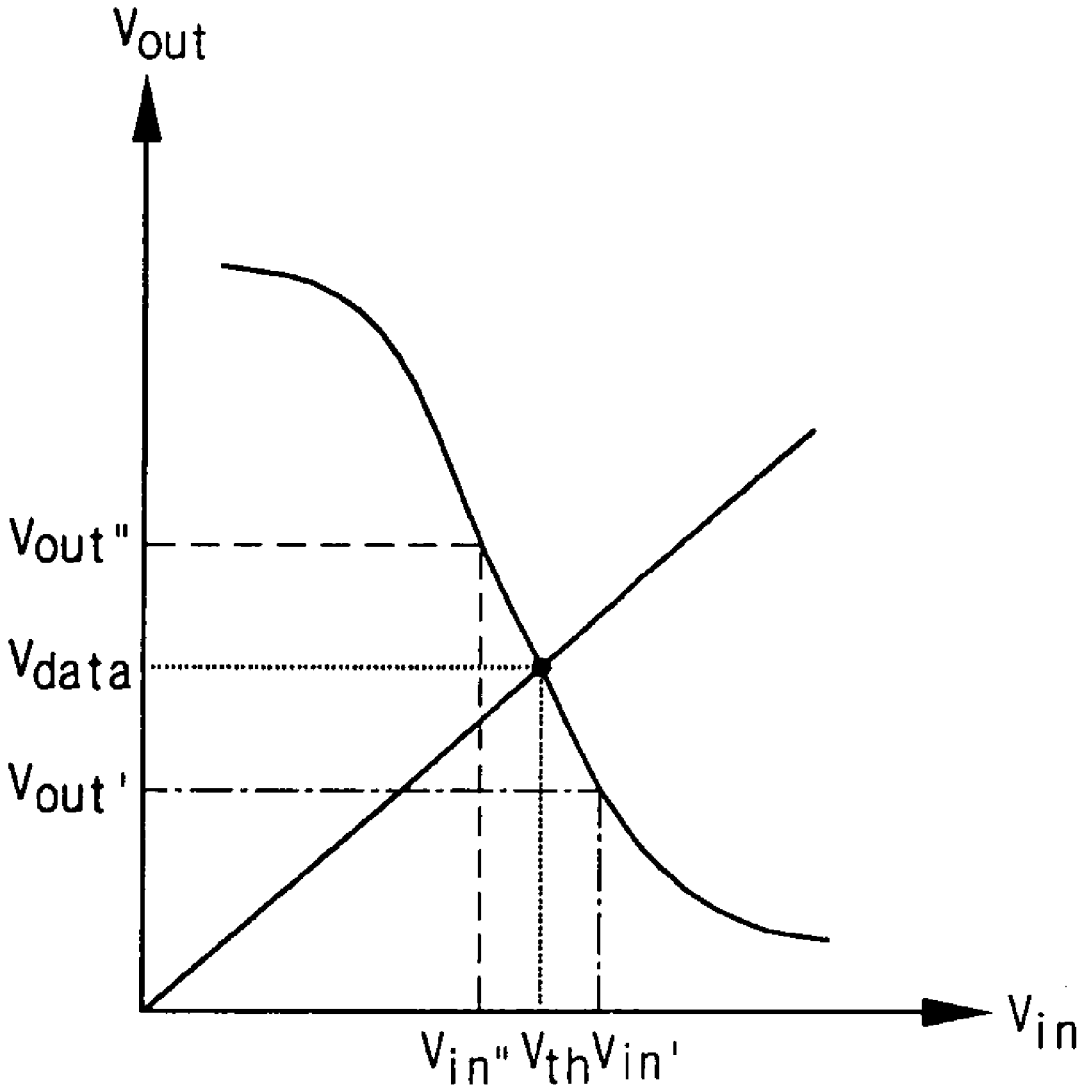
FIG. 3 shows the relationship between an input/output voltage and a threshold voltage in a driving transistor (T1) of FIG. 2.
Figure 4A:
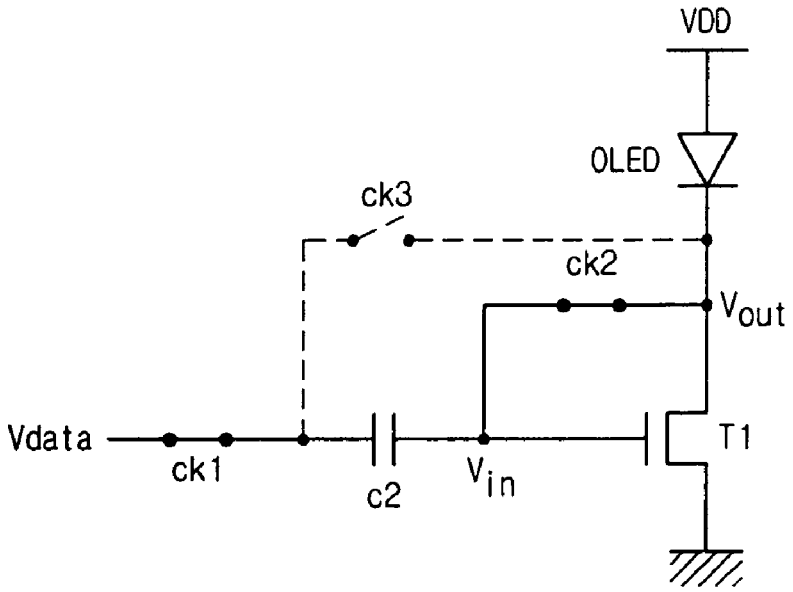
FIGS. 4A and 4B are circuit diagrams illustrating the operation of the pixel structure of FIG. 2 according to the embodiment of the present invention.
Figure 4B:
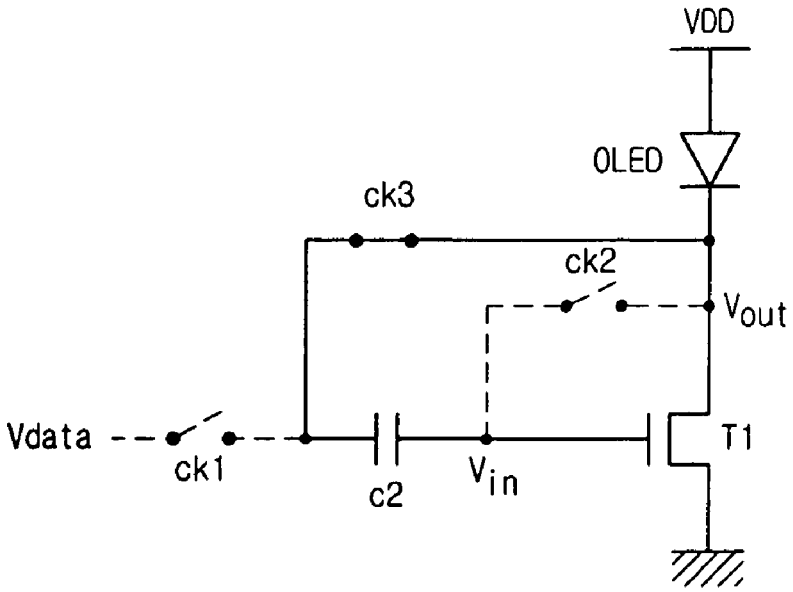

FIG. 3 shows the relationship between an input/output voltage and a threshold voltage in the driving transistor T1 of FIG. 2. FIGS. 4A and 4B are circuit diagrams illustrating the operation of the pixel structure of FIG. 2.

FIG. 4A is an equivalent circuit when the first and second switching elements ck1 and ck2 are turned on and the third switching element ck3 is turned off.

As illustrated in FIG. 4A, when the first and second switching elements ck1 and ck2 are turned on, a gate and a drain of the driving transistor T1 is equal. Therefore, Vout=Vin=Vth. In this case, the capacitor C2 is charged with the difference between a data voltage Vdata applied from the data line and a voltage Vin of the gate. Accordingly, that is, the charged voltage Vc of the capacitor C2 is equal to a voltage of Vdata−Vth.

Here, Vin represents a voltage applied to the gate of the driving transistor T1, and Vout represents a voltage applied to the drain of the driving transistor T1.

As illustrated in FIG. 4B, when the first and second switching element ck1 and ck2 are turned off, and the third switching element ck3 is turned on, the voltage Vout of the drain of the driving transistor T1 adds the charged voltage Vc of the capacitor C2 to a threshold voltage Vth. Therefore, Vout=Vin+Vdata−Vth.

The driving transistor T1 has a negative gain structure. Accordingly, as shown FIG. 3, the gate voltage Vin is inversely proportional to the drain voltage Vout.

In addition, as illustrated in FIG. 3, the threshold voltage $V_{th}$ of the driving transistor T1 is determined by an intersecting point of the inversely proportional curve and the proportionally straight line in a $V_{out}$−$V_{in}$ characteristic curve.

Referring to FIG. 4B, assuming that a voltage $V_{out}$ applied to the drain of the driving transistor T1 is higher than a data voltage $V_{data}$ applied from the data line, a voltage $V_{in}$ applied to the gate of the driving transistor T1 is higher than a threshold voltage $V_{th}$ of the driving transistor T1.

That is, $V_{out}'-V_{data}=V_{in}'-V_{th}>0$.

In this case, because $V_{in}'>V_{th}$, the voltage of $V_{out}'$ decreases.

On the contrary, if a voltage $V_{out}'$ applied to the drain of the driving transistor T1 is lower than a data voltage $V_{data}$ applied from the data line, a voltage of $V_{in}$" applied to the gate of the driving transistor T1 is lower than the threshold voltage $V_{th}$ of the driving transistor T1.

That is, $V_{out}''-V_{data}=V_{in}''-V_{th}<0$.

In this case, because $V_{in}''<V_{th}$, a voltage of $V_{out}$" increases.

Consequently, $V_{out}$ and $V_{data}$ are identical to each other and the voltage of $V_{out}$ finally applied to the drain of the driving transistor T1 is identical to the data voltage $V_{data}$ applied to the data line.

Accordingly, the driving current that is finally applied to the OLED is affected by only VDD and $V_{data}$. Unlike the related art, the driving current applied to the OLED is not affected by the threshold voltage $V_{th}$ of the driving transistor.

In the related art pixel structure, the deviation of the threshold voltage $V_{th}$ and the electron mobility in a thin film transistor is caused by non-uniformity of the related art manufacturing processes. Thus, the luminance deviation occurs in each pixel, resulting in non-uniformity of the picture quality. Consequently, the picture quality is degraded. However, in the illustrated embodiment of the present invention, the deviation of the threshold voltage $V_{th}$ will not affect the driving voltage applied to the OLED. Therefore, the driving current flowing through the OLED is determined by the difference of the supply voltage VDD and the data voltage $V_{data}$. Additionally, since the driving transistor T1 is operable in a linear region, the supply voltage VDD can be reduced. As a result, the power consumption is reduced and the reliability of the thin film transistor is improved.

Figure 5A:
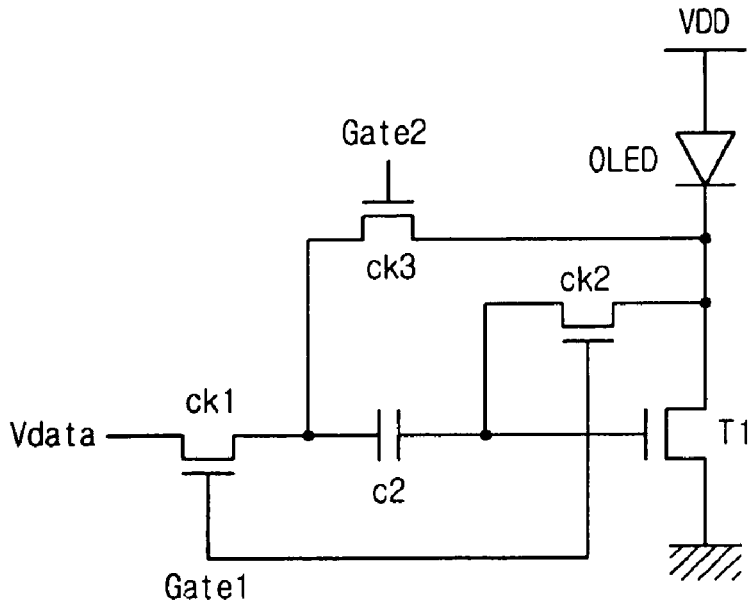
FIGS. 5A to 5C are circuit diagrams illustrating a pixel structure of an organic electro-luminescence device according to embodiments of the present invention.
Figure 5B:
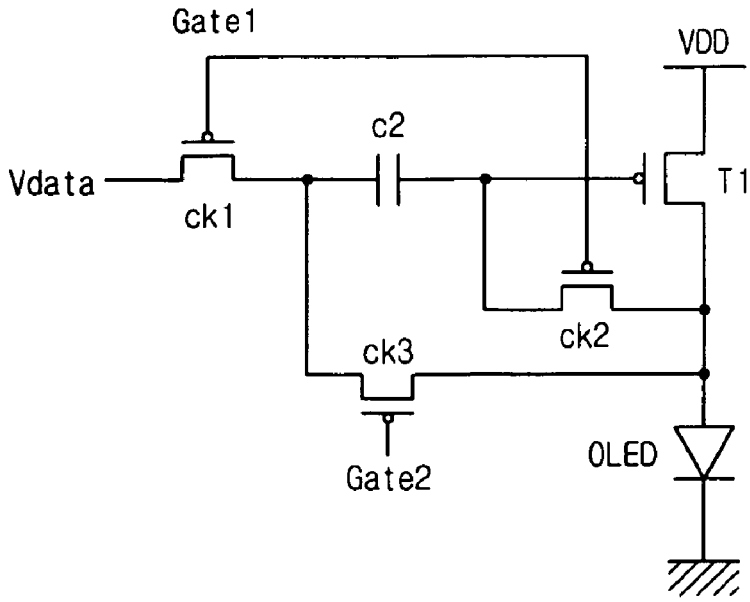
Figure 5C:
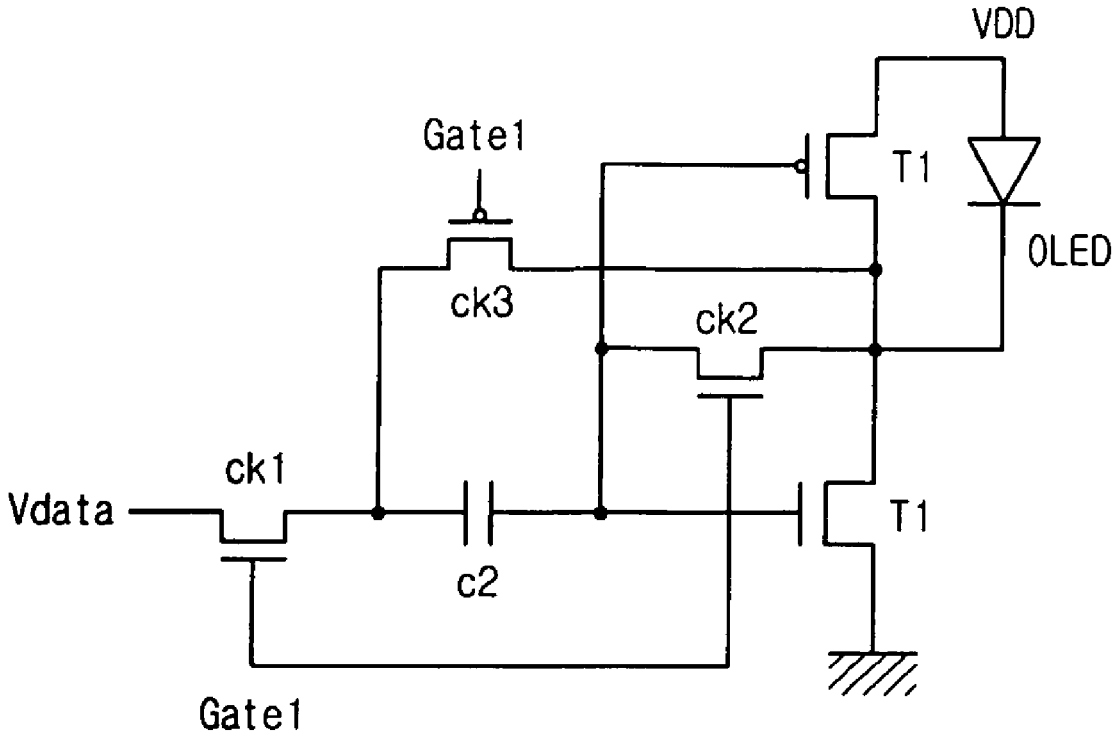

FIGS. 5A to 5C are some embodiments illustrating a pixel structure of an organic electro-luminescence device.

Referring to FIG. 5A, the driving transistor T1 includes an n-type thin film transistor (TFT), and the first, second and third switching elements ck1, ck2 and ck3 include n-type TFTs.

In this embodiment, the first and second switching elements ck1 and ck2 are turned on in response to a first scan signal Gate1 applied from the first gate line, and a data voltage applied from the data line is supplied to the pixel circuit through the first switching element ck1.

Also, the third switching element ck3 can be operated by a second scan signal Gate2 from a second gate line which has a logic level opposite to the logic level of the first and second switching elements ck1 and ck2. For example, when the first scan signal Gate1 is a logic high level, the second scan signal Gate2 can be a logic low level. On the contrary, when the first scan signal Gate1 is a logic low level, the second scan signal Gate2 is a logic high level. Accordingly, when the first and second switching elements ck1 and ck2 are turned on, the third switching element ck3 is turned off. When the first and second switching elements ck1 and ck2 are turned off, the third switching element ck3 is turned on.

In addition, the third switching element ck3 may also receive an inverted scan signal Gate2 from the first gate line or include a p-type TFT opposite to that of the first and second switching elements.

That is, when the first and second switching elements ck1 and ck2 are an n-type TFT and the third switching element ck3 is a p-type TFT, the third switching element ck3 is operated by a scan signal identical to that of the first, second and third switching elements ck1, ck2 and ck3. For example, when a logic high level is applied to the first, second and third switching elements ck1, ck2 and ck3, the first and second switching elements ck1 and ck2 are turned on, but the third switching element ck3 is turned off.

Referring to FIG. 5B, the driving transistor T1 and the switching element in this embodiment are a p-type TFT contrary to that of FIG. 5A. Similarly, the third switching element ck3 may receive an inverted scan signal Gate2 from the first gate line, or include an n-type TFT opposite to that of the first and second switching elements.

That is, when the first and second switching elements ck1 and ck2 are a p-type TFT and the third switching element ck3 is an n-type TFT, the third switching element ck3 operates identically as described above.

Additionally, the pixel structure of FIG. 5C is similar to that of FIG. 5. In this embodiment, the driving transistor T1 includes a CMOS type with an n-type TFT and a p-type TFT.

Since the operations of the pixel structure of FIGS. 5A to 5C are similar to those of FIGS. 3 and 4, a detailed description thereof will not be repeated.

As shown in the illustrated embodiments, the non-uniformity of the characteristics of the driving TFT in each pixel is compensated by using the driving transistor and the capacitor with the switching devices to remove the effect of the deviation of the threshold voltage of the driving transistor. Consequently, the circuit structure of each pixel is simplified and the picture quality is improved.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An organic electro-luminescence device, comprising:

a light-emitting device in a pixel for emitting light;

a data line for providing a data voltage;

a driving transistor connected to the light emitting device, wherein when the driving transistor is turned on to drive the light-emitting device, a driving voltage applied to the light emitting device reaches a value of a difference between a supply voltage and the data voltage;

a power line to supply the supply voltage;

a capacitor between the data line and a gate of the driving transistor for storing a voltage of a difference between the data voltage and a threshold voltage of the driving transistor;

a first switching device between the data line and the capacitor;

a second switching device between the gate of the driving transistor and a drain of the driving transistor; and a third switching device between one of an anode and a cathode of the light-emitting device and a node between the first switching device and the capacitor, wherein the supply voltage is supplied via the power line to an anode of the light-emitting device, wherein the driving transistor includes a negative gain circuit in which the drain of the driving transistor is connected to the gate of the driving transistor by the second switching device, wherein the third switching device is operated by a logic level opposite to the logic level supplied to the first and second switching devices, wherein the driving transistor and the capacitor constitutes a buffer circuit configured to buffer a driving voltage applied to the inside of the pixel, wherein each of the first switching device, the second switching device and the third switching device is a thin film transistor of the type which is identical, wherein the gate and the drain of the driving transistor is equal when the first and second switching devices are turned on, and the third switching device is turned off, the capacitor is charged with the difference between the data voltage and a voltage of the gate, wherein the voltage of the drain of the driving transistor adds the charged voltage of the capacitor to the threshold voltage when the first and second switching devices are turned off, and the third switching device is turned on, wherein the first and second switching devices are operated in response to a first scan signal applied from a first gate line among a plurality of gate lines, the third switching device is operated by a second scan signal applied from a next gate line of the first gate line, and wherein the second scan signal has a period of a low level when the first scan signal has a period of a high level, the second scan signal has a period of a high level when the first scan signal has a period of a low level.

2. The organic electro-luminescence device of claim 1, wherein the first switching device and the second switching device are on and the third switching device is off in a first period to charge the capacitor to the voltage of the difference between the data voltage and a threshold voltage of the driving transistor, and the first switching device and the second switching device are off and the third switching device is on in a second period so that a voltage of the drain of the driving transistor reaches the data voltage.

3. The organic electro-luminescence device of claim 1, wherein each of the first switching device, the second switching device and the third switching device is one of a p-type transistor and an n-type transistor.

4. The organic electro-luminescence device of claim 1, wherein the driving transistor is a CMOS (complementary metal oxide semiconductor) transistor.

5. The organic electro-luminescence device of claim 1, wherein the light-emitting device is an organic light-emitting diode.

6. A method for driving an organic electro-luminescent display device, comprising:

supplying a data voltage via a data line in a first period to charge a capacitor between the data line and a driving transistor to a value of a difference between the data voltage and a threshold voltage of the driving transistor;

applying a driving voltage via the driving transistor and the capacitor to a light emitting device with a value of a difference between a supply voltage and the data voltage in a second period;

supplying the supply voltage to an anode of the light-emitting device; and supplying the supply voltage to a source of the driving transistor, wherein the driving transistor includes a negative gain circuit in which a drain of the driving transistor is connected to a gate of the driving transistor by a switching elements, wherein the switching elements include a first switching device between the data line and the capacitor, a second switching device between the gate of the driving transistor and the drain of the driving transistor and a third switching device between one of an anode and a cathode of the light-emitting device and a node between the first switching device and the capacitor, wherein the third switching device is operated by a logic level opposite to the logic level supplied to the first and second switching devices, wherein the driving transistor and the capacitor constitutes a buffer circuit configured to buffer a driving voltage applied to the inside of the pixel, wherein each of the first switching device, the second switching device and the third switching device is a thin film transistor, wherein the gate and the drain of the driving transistor is equal when the first and second switching devices are turned on, and the third switching device is turned off, the capacitor is charged with the difference between the data voltage and a voltage of the gate, wherein the voltage of the drain of the driving transistor adds the charged voltage of the capacitor to the threshold voltage when the first and second switching devices are turned off, and the third switching device is turned on, wherein the first and second switching devices are operated in response to a first scan signal applied from a first scan line among a plurality of scan lines, the third switching device is operated by a second scan signal applied from a next scan second gate line of the first scan line, wherein each of the first switching device, the second switching device and the third switching device is a thin film transistor of the type which is identical, and wherein the second scan signal has a period of a low level when the first scan signal has a period of a high level, the second scan signal has a period of a high level when the first scan signal has a period of a low level.

7. The method of claim 6, wherein the step of supplying the data voltage to charge the capacitor includes:

substantially short-circuiting the gate and the drain of the driving transistor in the first period; and supplying the data voltage to the capacitor to charge the capacitor to the value of the difference between the data voltage and the threshold voltage of the driving transistor.

8. The method of claim 7, wherein the step of applying the driving voltage to the light emitting device includes:

stopping supplying of the data voltage to the capacitor in the second period;

stopping short-circuiting of the gate and the drain of the driving transistor in the second period; and substantially short-circuiting the drain of the driving transistor and one electrode of the capacitor opposite to another electrode connected to the gate of the driving transistor, so as to apply the driving voltage to the light emitting device with a value of a difference between a supply voltage and the data voltage in a second period.

9. The method of claim 8, wherein the steps of substantially short-circuiting the gate and the drain of the driving transistor, stopping supplying of the data voltage, stopping short-circuiting of the gate and the drain of the driving transistor in the second period, and substantially short-circuiting the drain of the driving transistor and the one electrode of the capacitor are performed by using a scan signal.

10. The method of claim 6, wherein the step of applying the driving voltage to the light emitting device includes:

substantially short-circuiting a drain of the driving transistor and one electrode of the capacitor opposite to another electrode connected to a gate of the driving transistor, so as to apply the driving voltage to the light emitting device with a value of a difference between a supply voltage and the data voltage in a second period.

* * * * *